US009055638B2

(12) United States Patent
Nakada et al.

(10) Patent No.: US 9,055,638 B2
(45) Date of Patent: Jun. 9, 2015

(54) LIGHTING DEVICE AND LIGHTING FIXTURE

(71) Applicant: PANASONIC CORPORATION, Osaka (JP)

(72) Inventors: Katsuyoshi Nakada, Kyoto (JP); Nobuo Ukita, Hyougo (JP); Hisanaga Onishi, Hyougo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 262 days.

(21) Appl. No.: 13/892,364

(22) Filed: May 13, 2013

(65) Prior Publication Data

US 2013/0328497 A1 Dec. 12, 2013

(30) Foreign Application Priority Data

Jun. 8, 2012 (JP) ..... 2012-131280

(51) Int. Cl.
*H05B 37/02* (2006.01)
*H05B 33/08* (2006.01)

(52) U.S. Cl.
CPC ..... *H05B 33/0818* (2013.01); *H05B 33/08* (2013.01); *H05B 33/0851* (2013.01)

(58) Field of Classification Search
CPC . H05B 33/08; H05B 33/0818; H05B 33/0851
USPC ..... 315/224, 209 R, 291, 307, 312
See application file for complete search history.

(56) References Cited

U.S. PATENT DOCUMENTS

| | | | | |
|---|---|---|---|---|
| 6,016,038 | A * | 1/2000 | Mueller et al. | 315/291 |
| 6,392,358 | B1 * | 5/2002 | Runau et al. | 315/185 R |
| 6,987,787 | B1 * | 1/2006 | Mick | 372/29.021 |
| 7,420,335 | B2 * | 9/2008 | Robinson et al. | 315/224 |
| 7,888,881 | B2 * | 2/2011 | Shteynberg et al. | 315/291 |
| 8,339,053 | B2 * | 12/2012 | Yamasaki et al. | 315/209 R |
| 8,400,079 | B2 * | 3/2013 | Kanamori et al. | 315/307 |
| 8,803,446 | B2 * | 8/2014 | Masumoto | 315/307 |
| 2007/0103086 | A1 | 5/2007 | Neudorf et al. | |
| 2008/0191642 | A1 | 8/2008 | Slot et al. | |
| 2010/0219764 | A1 | 9/2010 | Yamasaki et al. | |

FOREIGN PATENT DOCUMENTS

| | | |
|---|---|---|
| EP | 2214457 | 8/2010 |
| EP | 2364064 | 9/2011 |

(Continued)

OTHER PUBLICATIONS

Search report from E.P.O., mail date is Sep. 10, 2013.

*Primary Examiner* — Kenneth Wells
(74) *Attorney, Agent, or Firm* — Greenblum & Bernstein P.L.C.

(57) ABSTRACT

The controller changes an applied time (ON-time) of a DC voltage while keeping an intermittent period in which the DC voltage is supplied intermittently constant, when adjusting an average value of currents to a predetermined reference value or more, and changes a stopped time (OFF-time) of the DC voltage together with the intermittent period while keeping the applied time constant, when adjusting the average value to a value less than the predetermined reference value. Therefore, the lighting device can reduce variation in emission color compared with the conventional lighting device adopting DC Dimming Method, and can reduce variation in amount of light compared with the case where ON-time is changed until the dimming level reaches a lower limit. As a result, the lighting device can modulate light even at a low dimming level while reducing variation in emission color and variation in amount of light.

6 Claims, 5 Drawing Sheets

(56) References Cited

FOREIGN PATENT DOCUMENTS

| | | |
|---|---|---|
| JP | 2010-040400 | 2/2010 |
| JP | 2011-108671 | 6/2011 |
| JP | 2011-171231 | 9/2011 |
| JP | 2011-181454 | 9/2011 |
| JP | 2011-192399 | 9/2011 |

* cited by examiner

LIGHTING DEVICE AND LIGHTING FIXTURE

BACKGROUND OF THE INVENTION

1. Field of the Invention

The invention relates generally to lighting devices and lighting fixtures and, more particularly, to a lighting device which activates a light source being a solid-state light emitting element, and a lighting fixture comprising the same.

2. Description of the Related Art

Recently, a lighting device and a lighting fixture have rapidly become widely used, which adopts, as a light source, a solid-state light emitting element such as a light-emitting diode or an organic electroluminescence (EL) element, as substitute for an incandescent lamp and a fluorescent lamp. For example, Japanese Patent Application Laid-Open No. 2011-108671 discloses a lighting device (an LED dimming device) which adopts, as a light source, a light-emitting diode (LED) and adjusts (dims) amount of light outputted from the LED based on a dimming signal provided by a dimmer.

Here, as a dimming method of LED, there are a dimming method in which magnitude of current continuously flowing to an LED is changed (hereinafter, called DC (Direct Current) Dimming Method), a dimming method in which a ratio of a conducting period (a duty cycle) is changed by periodically switching the current flowing to an LED on and off (hereinafter, called Burst Dimming Method), and the like. Then, as the conventional lighting device described in the above-mentioned document, there is also a case in which when the dimming level is relatively high (bright), the DC Dimming Method is adopted, and when the dimming level is relatively low (dark), the Burst Dimming Method is adopted.

Incidentally, as the conventional lighting device described in the above-mentioned document, the lighting device and lighting fixture adopting the DC Dimming Method has a problem that when decreasing current continuously flowing to an LED, the emission color of the LED changes in response to magnitude of the current.

Generally, a switching power circuit is used in a lighting circuit that activates an LED. As the dimming level in the Burst Dimming Method is reduced, the conducting period during which the switching power circuit performs the switching operation shortens, thereby increasing variation in the number of the switching operation performed by the switching power circuit within the conducting period. Therefore, there is a problem that the lower the dimming level is, the more variation in amount of light increases.

SUMMARY OF THE INVENTION

It is an object of the present invention to provide a lighting device and a lighting fixture, which can modulate light even at a low dimming level while reducing variation in emission color and variation in amount of light.

A lighting device of the present invention comprises: a power section applying a DC voltage to a solid-state light emitting element that is a light source; and a controller controlling said power section to intermittently supply said DC voltage, using an intermittent period, thereby adjusting an average value of currents flowing to said solid-state light emitting element to a value corresponding to a dimming level instructed from outside, wherein said intermittent period includes an applied time during which said DC voltage is applied continuously, and a stopped time during which applying of said DC voltage is stopped temporarily, wherein said controller is configured: to change said applied time while keeping said intermittent period constant, when adjusting said average value to a predetermined reference value or more; and to change said stopped time together with said intermittent period while keeping said applied time constant, when adjusting said average value to a value less than said predetermined reference value, and wherein said predetermined reference value is set to be less than an upper limit value for said average value, and to be more than a lower limit value for said average value.

In the lighting device, preferably, said controller is configured to set said intermittent period upon adjusting said average value to said predetermined reference value or more so as to be shorter than said intermittent period upon adjusting said average value to a value less than said predetermined reference value.

In the lighting device, preferably, said controller is configured to change said stopped time continuously based on said dimming level when adjusting said average value to a value less than said predetermined reference value.

In the lighting device, preferably, said controller is configured to change said stopped time in stages based on said dimming level when adjusting said average value to a value less than said predetermined reference value.

In the lighting device, preferably, said controller is configured to increase or decrease a peak value of output current of said power section based on said dimming level when adjusting said average value to said predetermined reference value or more.

A lighting fixture of the present invention comprises: a solid-state light emitting element; any one of the above-mentioned lighting devices; and a main body supporting said solid-state light emitting element and the lighting device.

The lighting device and the lighting fixture of the present invention adjusts a time during which current flows to the solid-state light emitting element, thereby modulating light, and then changes a stopped time of a DC voltage together with an intermittent period while keeping an applied time of the DC voltage constant when adjusting an average value of currents flowing to the solid-state light emitting element to a value less than a predetermined reference value. Therefore, the lighting device and the lighting fixture can modulate light even at a low dimming level while reducing variation in emission color and variation in amount of light.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

A lighting device according to the present embodiment, which adopts a light-emitting diode as a light source, will be explained below. However, a solid-state light emitting element that can be activated by the lighting device of the present embodiment is not limited to the light-emitting diode. For example, the light source may be other solid-state light emitting element, such as an organic EL element.

Figure 1:
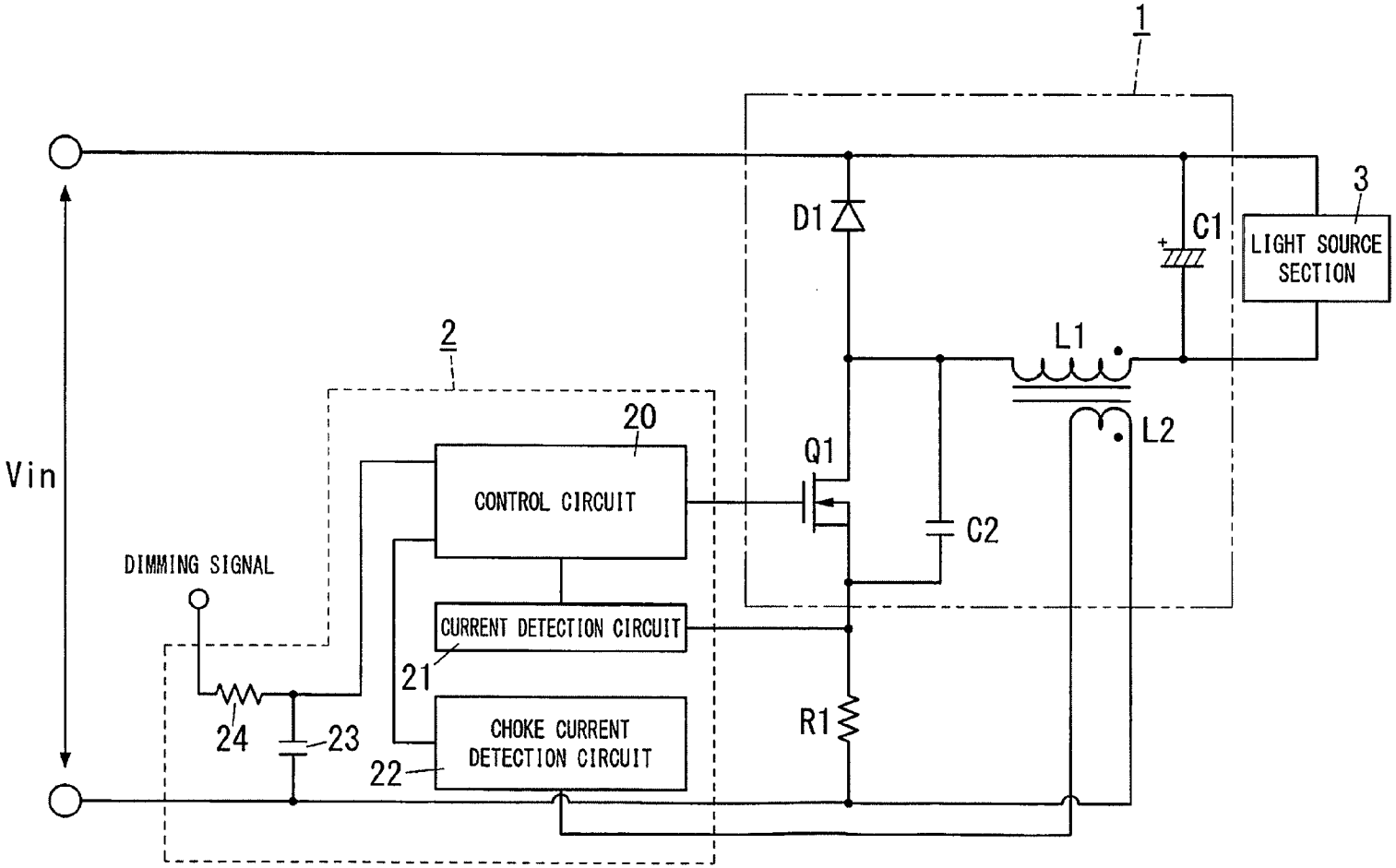
FIG. 1 is a circuit diagram showing a lighting device according to the present embodiment.

As shown in FIG. 1, the lighting device according to the present embodiment includes: a power section 1 that steps down an input voltage Vin being a DC voltage to a voltage applicable to a light source section 3; and a controller 2 that controls the power section 1. The light source section 3 includes a series circuit having a plurality of light-emitting diodes (not shown), or several series circuits that are connected in parallel, each having a plurality of light-emitting diodes. A rated voltage for the light source section 3 is equal to a voltage obtained by multiplying a forward voltage of a light-emitting diode by the number of the light-emitting diodes connected in series.

The power section 1 is a widely-known non-isolated buck converter which includes a switching element Q1 being a field-effect transistor, a choke coil L1, a diode D1, a smoothing capacitor C1, a capacitor C2, and the like. An anode of the diode D1, one end of the choke coil L1 and one end of the capacitor C2 are connected to a drain of the switching element Q1. The other end of the capacitor C2 and one end of a sensing resistor R1 are connected to a source of the switching element Q1. The other end of the choke coil L1 is connected to: one end of the smoothing capacitor C1 located at a low voltage side; and one end of the light source section 3 (a cathode of the light-emitting diode). A cathode of the diode D1 is connected to: the other end of the smoothing capacitor C1 located at a high voltage side; and the other end of the light source section 3 (an anode of the light-emitting diode). Then, the input voltage Vin is applied across the cathode of the diode D1 and the other end of the sensing resistor R1. Further, a detecting coil L2 is magnetically coupled to the choke coil L1 to detect current (choke current) flowing to the choke coil L1. However, the above-mentioned circuit configuration of the power section 1 is one example. As long as a switching power circuit can step down the input voltage Vin to the rated voltage or less for the light source section 3, other circuit configuration can be also adopted.

Figure 2A:
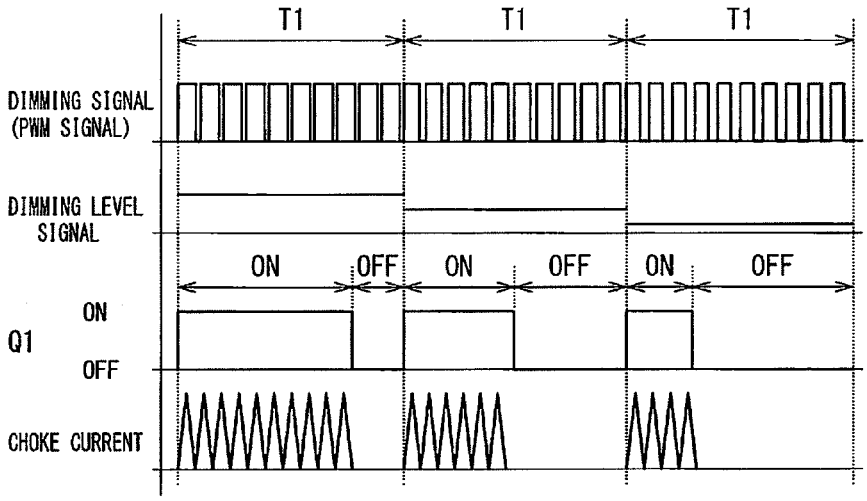
FIG. 2A is a waveform chart for explaining operation of the lighting device according to the present embodiment.
Figure 2B:
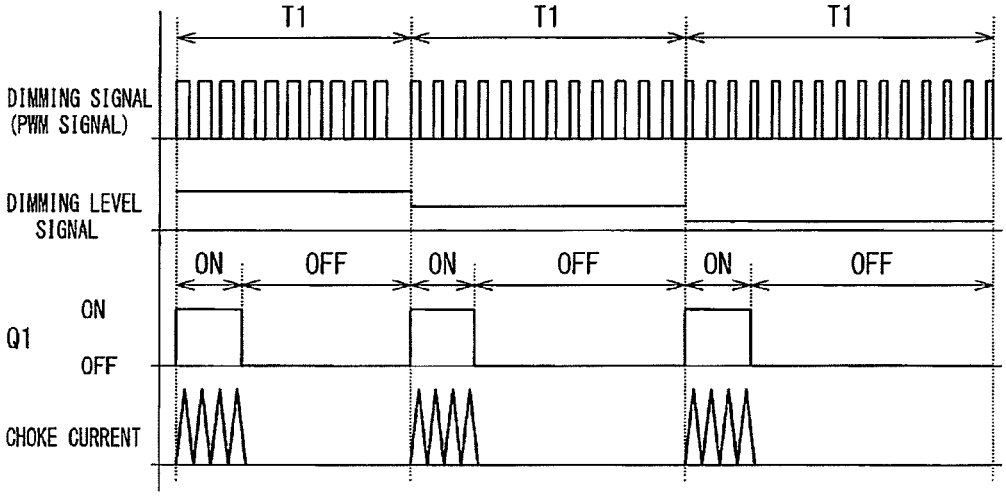
FIG. 2B is a waveform chart for explaining operation of the lighting device according to the present embodiment.

The controller 2 includes a control circuit 20, a current detection circuit 21, a choke current detection circuit 22, a capacitor 23 and a resistor 24. The current detection circuit 21 detects a voltage across the sensing resistor R1, thereby indirectly detecting the current flowing to the switching element Q1 and outputting, into the control circuit 20, a detection voltage proportional to the current flowing to the switching element Q1. The choke current detection circuit 22 indirectly detects choke current (current flowing to the light source section 3) based on a voltage across the detecting coil L2, and calculates an average value of the detected currents (a time average value of current) (hereinafter, called a current average value), and outputs into the control circuit 20 a detection voltage corresponding to the current average value. The capacitor 23 and the resistor 24 constitute an integral circuit. The integral circuit integrates a dimming signal inputted, as a PWM (Pulse Width Modulation) signal, from outside, and outputs into the control circuit 20 a DC voltage signal corresponding to a duty cycle of the dimming signal. The dimming signal is a periodic square wave signal, in which the lower the dimming level is (the less amount of light is), the more the duty cycle is shortened (see FIGS. 2A and 2B).

Here, the dimming level is denoted by a rate of the current average value of the light source section 3, and is defined as 100% in the case where the rated current constantly flows to the light source section 3 to perform the rating activation. For example, a lower limit value for the dimming level is set to 10%. In the present embodiment, as one example, a reference value for the dimming level (the rate of the current average value) is set to 20%. However, the reference value is not limited to 20%, and may be more than the lower limit value (10%) but less than 20%, or may be more than 20% but less than the rated value (100%).

Then, operation of the controller 2 according to the dimming signal is explained below. First, a case is explained, in which the dimming signal including the dimming level being equal to or more than the reference value is inputted into the controller 2. In the controller 2, the integral circuit of the resistor 24 and capacitor 23 integrates the dimming signal inputted from a dimmer or the like to convert into a signal (hereinafter, called a dimming level signal) which includes a voltage corresponding to the dimming level (the duty cycle) in the dimming signal. Then, the control circuit 20 receives the dimming level signal. That is, the higher the dimming level (the duty cycle) is, the higher a signal voltage of the dimming level signal is.

The control circuit 20 switches, with a high-frequency, the switching element Q1 in the power section 1 within an ON-time corresponding to the dimming level for each constant intermittent period T1, when the signal voltage of the dimming level signal is equal to or more than a voltage value corresponding to the reference value for the dimming level. The control circuit 20 does not perform the switching operation of the switching element Q1 within an OFF-time (obtained by subtracting the ON-time from the intermittent period T1). That is, after starting the switching operation of the switching element Q1, the control circuit 20 stops the switching operation of the switching element Q1 temporarily when the current average value corresponding to the detection voltage outputted from the choke current detection circuit 22 reaches the current average value corresponding to the dimming level signal (see FIG. 2A). In this case, stopping of the switching operation is performed at a timing of when the detection voltage outputted from the choke current detection circuit 22 is 0[V], that is, at a timing of when the current does not flow to the switching element Q1.

As explained above, the ON-time of the present embodiment is an applied time during which the DC voltage is applied continuously through the switching operation of the switching element Q1. The OFF-time is a stopped time during which applying of the DC voltage is stopped temporarily through stopping of the switching operation. Each intermittent period T1 includes the ON-time and the OFF-time. Then, the controller 2 controls the power section 1 to intermittently supply the DC voltage, using the intermittent period T1, thereby adjusting the current average value to a value corresponding to the dimming level instructed from outside.

Next, a case is explained, in which the dimming signal including the dimming level being a value less than the reference value is inputted into the controller 2. The control circuit 20 changes the OFF-time based on the dimming level together with the intermittent period T1 while keeping the ON-time constant so as to become an ON-time used in a case where the signal voltage is equal to a voltage value corresponding to the reference value, when the signal voltage of the dimming level signal is less than a voltage value corresponding to the reference value for the dimming level. That is, after stopping the switching operation of the switching element Q1 at the end of the ON-time, the control circuit 20 starts the switching operation again when the current average value corresponding to the detection voltage outputted from the choke current detection circuit 22 reaches the current average value corresponding to the dimming level signal (see FIG. 2B).

For example, the rated current for the light source section 3 is set to 150 [mA], a switching frequency in the power section 1 is set to 50 [kHz], a current corresponding to the reference value for the dimming level is set to 30 [mA], and a current corresponding to the lower limit value for the dimming level is set to 15 [mA]. Here, if the current average value is set to the current (15 [mA]) corresponding to the lower limit value for the dimming level without keeping the ON-time constant, the number of the switching operation performed within the ON-time becomes 5. In this case, when the number of the switching operation becomes 4 or 6, variation in the current average value becomes +−20%. For this reason, a flicker caused by the light source section 3 becomes an issue.

On the other hand, according to the present embodiment, the control circuit 20 sets the current average value to 15 [mA] by controlling a ration of the ON-time and the OFF-time as the ratio 1:9 when modulating light at the lower limit value for the dimming level. In this case, the number of the switching operation performed within the ON-time becomes 10. Therefore, even when the number of the switching operation becomes 9 or 11 due to variation in the switching frequency, variation in the current average value can be kept within a range of +−10%. Accordingly, the flicker caused by the light source section 3 can be reduced, compared with the case where the ON-time is not kept constant.

As described above, the controller 2 changes the applied time (the ON-time) of the DC voltage while keeping the intermittent period T1, in which the DC voltage is supplied intermittently, constant, when adjusting the current average value to a predetermined reference value (that is, it means the reference value for the current average value corresponding to the reference value for the dimming level, and hereinafter, the predetermined reference value is defined as the same) or more. The controller 2 changes the stopped time (the OFF-time) of the DC voltage together with the intermittent period T1 while keeping the applied time of the DC voltage constant when adjusting the current average value to a value less than the predetermined reference value. Thus, the lighting device according to the present embodiment can reduce variation in emission color compared with the conventional lighting device adopting DC Dimming Method, and can reduce variation in amount of light compared with the case where the ON-time is changed until the dimming level reaches a lower limit. As a result, the lighting device according to the present embodiment can modulate light even at a low dimming level while reducing variation in emission color and variation in amount of light. In this case, preferably, the controller 2 sets the intermittent period T1 upon adjusting the current average value to the predetermined reference value or more so as to be shorter than the intermittent period T1 upon adjusting the average value to a value less than the predetermined reference value.

Figure 3A:
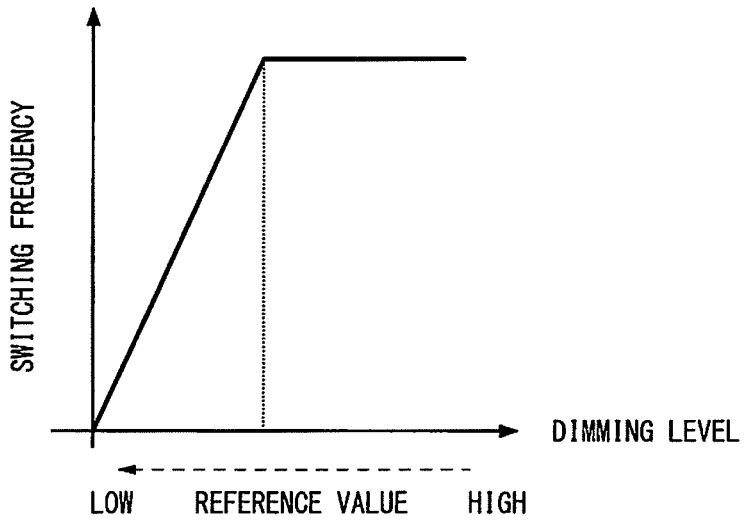
FIG. 3A is a diagram showing a relationship between a dimming level and a switching frequency in the lighting device according to the present embodiment.
Figure 3B:
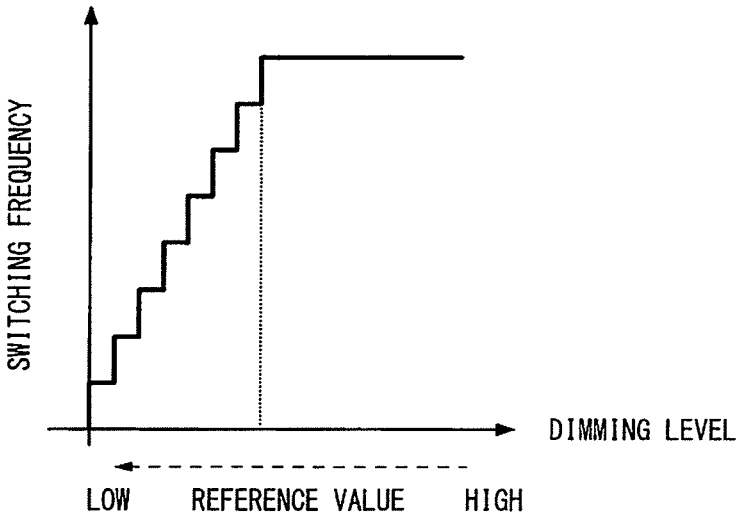
FIG. 3B is a diagram showing a relationship between a dimming level and a switching frequency in the lighting device according to the present embodiment.

When adjusting the current average value to a value less than the predetermined reference value, the controller 2 may change the OFF-time, based on the dimming level, continuously (see FIG. 3A) or in stages (see FIG. 3B).

Figure 4:
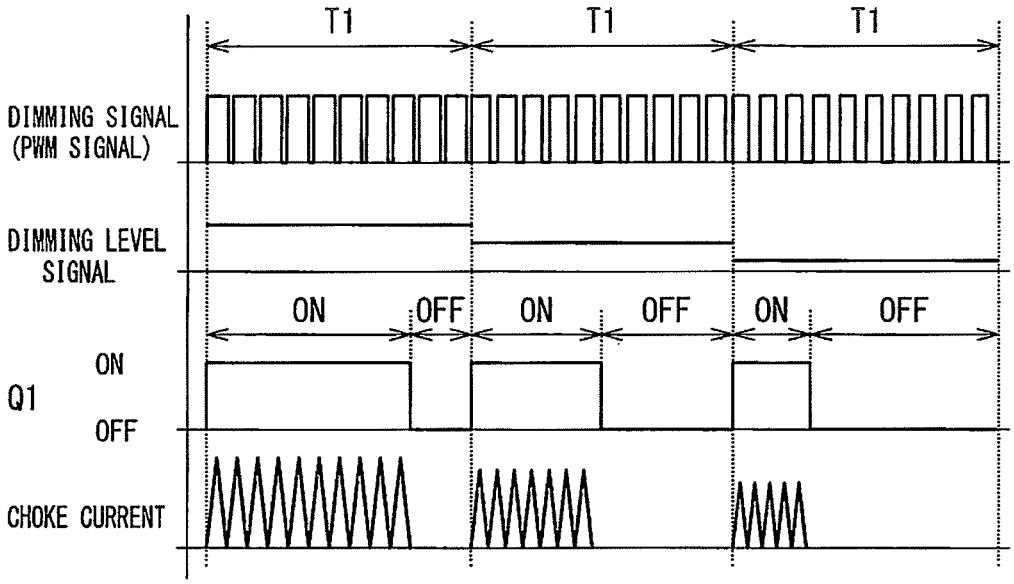
FIG. 4 is a waveform chart for explaining operation of another example of the lighting device according to the present embodiment.

Then, when adjusting the current average value to the predetermined reference value or more, the controller 2 may increase or decrease a peak value of output current (choke current) of the power section 1 based on the dimming level. That is, as shown in FIG. 4, the controller 2 decreases the peak value of the choke current, as the dimming level is reduced and the ON-time is shortened. Therefore, the lighting device can increase the number of the switching operation performed within the ON-time, compared with the case where the peak value of the choke current is kept constant. However, when the peak value of the choke current is changed, the emission color of the light source section 3 may change. For this reason, it is preferred that the peak value of the choke current is changed only in the situation where a change in the emission color is hardly recognized visibly, that is, the situation where the dimming level is relatively high.

Next, a lighting fixture according to the present embodiment will be explained below.

Figure 5A:
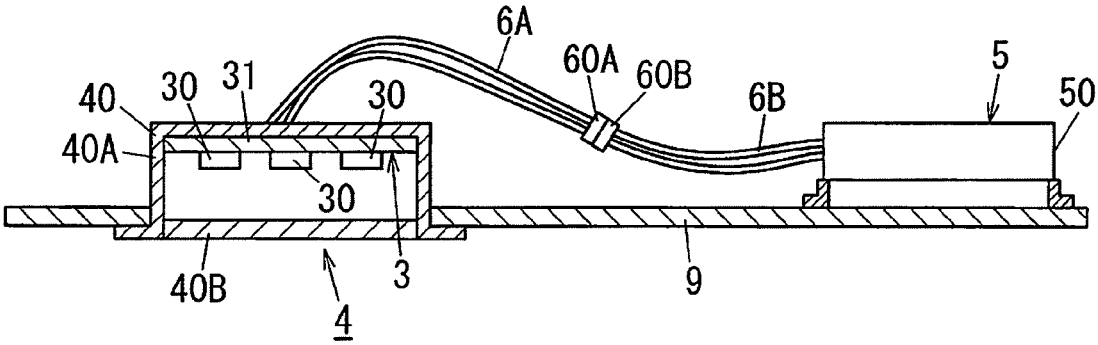
FIG. 5A is a cross-section view showing one example of a lighting fixture according to the present embodiment.

The lighting fixture shown in FIG. 5A includes: a light source unit 4 having a housing 40 that stores the light source section 3 in which a plurality of LEDs 30 are mounted on a disk-shaped substrate 31; a power supply unit 5 having a box-shaped casing 50 that stores the above-mentioned lighting device; and cables 6A, 6B connecting the light source unit 4 and the power supply unit 5. The housing 40 includes a housing body 40A which is formed into a cylindrical shape having the bottom and is provided at its open end with a flange, and a cover 40B which is formed of a translucent material into a disk-shape and covers the opening of the housing body 40A. Then, the housing 40 is located by being embedded via a hole for embedding that is provided at a ceiling 9. A cable 6A is pulled out via a through-hole that is provided at the center of the bottom surface (the upper surface in FIG. 5A) of the housing body 40A, and is provided at its tip with a connector 60A. The power supply unit 5 is located above the ceiling 9. A connector 60B provided at a tip of a cable 6B pulled out from the power supply unit 5 is connected to the connector 60A provided at the tip of the cable 6A pulled out from the light source unit 4. In this case, the housing 40 and the casing 50 correspond to a main body of the present embodiment.

Figure 5B:
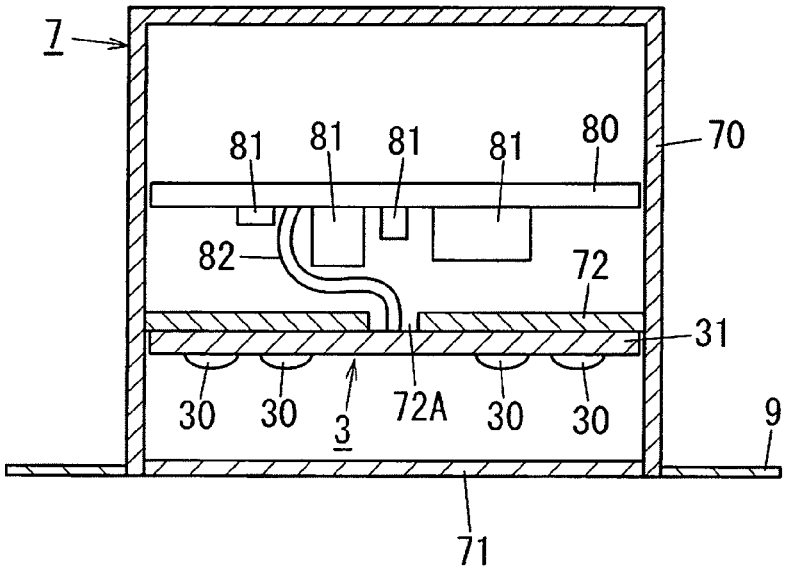
FIG. 5B is a cross-section view showing another example of the lighting fixture according to the present embodiment.

As another example according to the present embodiment, there is a lighting fixture shown in FIG. 5B. The lighting fixture is characterized in that a single housing 7 stores both of the light source section 3 and the lighting device. The housing 7 includes: a main body 70 which is formed into a cylindrical shape having the bottom and is located by being embedded in a ceiling 9; and a cover 71 which is formed of a translucent material into a disk-shape and covers the opening of the main body 70. In the main body 70, an attachment plate 72 is provided so as to face the cover 71 in parallel. Then, the light source section 3 is attached at a lower surface side of the attachment plate 72. The lighting device is made by mounting circuit components 81, which constitute the power section 1 and the controller 2, on a disk-shaped printed-wiring board 80. In the main body 70, the lighting device is located between the bottom surface (the top surface in FIG. 5B) and the light source section 3. An electrical wire 82 pulled out from the printed-wiring board 80 is connected to the light source section 3 via a through-hole 72A that opens at the center of the attachment plate 72.

Although the present invention has been described with reference to certain preferred embodiments, numerous modifications and variations can be made by those skilled in the art without departing from the true spirit and scope of this invention, namely claims.

The invention claimed is:

1. A lighting device, comprising:

a power section applying a DC voltage to a solid-state light emitting element that is a light source; and a controller controlling said power section to intermittently supply said DC voltage, using an intermittent period, thereby adjusting an average value of currents flowing to said solid-state light emitting element to a value corresponding to a dimming level instructed from outside, wherein said intermittent period includes an applied time during which said DC voltage is applied continuously, and a stopped time during which applying of said DC voltage is stopped temporarily, wherein said controller is configured: to change said applied time while keeping said intermittent period constant, when adjusting said average value to a predetermined reference value or more; and to change said stopped time together with said intermittent period while keeping said applied time constant, when adjusting said average value to a value less than said predetermined reference value, and wherein said predetermined reference value is set to be less than an upper limit value for said average value, and to be more than a lower limit value for said average value.

2. The lighting device according to claim 1, wherein said controller is configured to set said intermittent period upon adjusting said average value to said predetermined reference value or more so as to be shorter than said intermittent period upon adjusting said average value to a value less than said predetermined reference value.

3. The lighting device according to claim 1, wherein said controller is configured to change said stopped time continuously based on said dimming level when adjusting said average value to a value less than said predetermined reference value.

4. The lighting device according to claim 1, wherein said controller is configured to change said stopped time in stages based on said dimming level when adjusting said average value to a value less than said predetermined reference value.

5. The lighting device according to claim 1, wherein said controller is configured to increase or decrease a peak value of output current of said power section based on said dimming level when adjusting said average value to said predetermined reference value or more.

6. A lighting fixture, comprising:

a solid-state light emitting element;

the lighting device according to claim 1; and a main body supporting said solid-state light emitting element and the lighting device.

* * * * *